United States Patent [19]

Maruyama et al.

[11] Patent Number: 4,672,015

[45] Date of Patent: Jun. 9, 1987

[54] ELECTROPHOTOGRAPHIC MEMBER HAVING MULTILAYERED AMORPHOUS SILICON PHOTOSENSITIVE MEMBER

[75] Inventors: Eiichi Maruyama, Kodaira; Makoto Fujikura, Hitachi; Hirokazu Matsubara, Nishitama; Toshikazu Shimada, Kokubunji, all of Japan

[73] Assignee: Hitachi, Ltd., Tokyo, Japan

[21] Appl. No.: 809,183

[22] PCT Filed: Dec. 14, 1984

[86] PCT No.: PCT/JP84/00598

§ 371 Date: Dec. 16, 1985

§ 102(e) Date: Dec. 16, 1985

[87] PCT Pub. No.: WO85/02691

PCT Pub. Date: Jun. 20, 1985

[30] Foreign Application Priority Data

Dec. 16, 1983 [JP] Japan ..... 58-236176

[51] Int. Cl.[4] ..... G03G 5/082

[52] U.S. Cl. ..... 430/57; 430/95

[58] Field of Search ..... 430/57, 58, 84, 95

[56] References Cited

U.S. PATENT DOCUMENTS

| | | | |
|---|---|---|---|
| 4,451,549 | 5/1984 | Kato | 430/57 |
| 4,532,198 | 7/1985 | Saitoh et al. | 430/84 |
| 4,555,462 | 11/1985 | Yamazaki | 430/84 |

*Primary Examiner*—John L. Goodrow

*Attorney, Agent, or Firm*—Antonelli, Terry & Wands

[57] ABSTRACT

The invention relates to an electrophotographic member which is highly sensitive to the light of long wavelengths. Amorphous silicon is used as a photosensitive base member. A long wavelength sensitizing region has a narrower forbidden band gap width than that of the base member, and consists of at least two semiconductor films that are laminated and that have at least different forbidden band gap widths or different conductivities. An increased number of semiconductor films may, of course, be laminated to constitute the sensitizing region.

21 Claims, 8 Drawing Figures

ELECTROPHOTOGRAPHIC MEMBER HAVING MULTILAYERED AMORPHOUS SILICON PHOTOSENSITIVE MEMBER

TECHNICAL FIELD

The present invention relates to an electrophotographic member which contains amorphous silicon, and particularly to an improved structure of an electrophotographic member for a laser beam printer which makes use of a semiconductor laser.

BACKGROUND ART

Amorphous selenium, a composite material consisting of a CdS powder and an organic binder, and an organic photoconductive member have heretofore been used as electrophotographic members. In recent years, attention has been given to hydrogenated or halogenated amorphous silicon that works as a photoconductive material having a high resistance. Compared with the conventional photoconductive materials for electrophotography, this material exhibits a high photo response in the range of visible light, increased hardness and decreased toxicity, and is considered to be close to an ideal electrophotographic member. However, this material does not exhibit sharp photo response over a range of 780 to 800 nm where the wavelengths of light emitted by a semiconductor laser fall. Therefore, it has been desired to increase the sensitivity of this material for the light of wavelengths that lie over this region.

The art which uses amorphous silicon as the photosensitive film has been reported in Japanese Patent Laid-Open No. 78135/1979, and the structure which uses amorphous silicon as a photosensitive base film to exhibit a high sensitivity for the light of long wavelengths has been reported in Japanese Patent Laid-Open No. 146142/1981.

DISCLOSURE OF INVENTION

The object of the present invention is to provide structure of a photosensitive member which is highly sensitive and stable over a region of long wavelengths of light from a semiconductor laser.

In order to increase the sensitivity for the light of long wavelengths, the present invention deals with a composite structure consisting of two or more films that are sensitive to the light of long wavelengths, that form carriers, and that have different optical or electrical characteristics.

Concretely speaking, the present invention is concerned with an electrophotographic member having amorphous silicon layers, wherein at least two semiconductor films are laminated to form a region that produces carriers responsive to the light of long wavelengths, the two semiconductor films having at least different forbidden band gap widths or different electrical conductivities.

When a plurality of semiconductor films are used having different forbidden band gap widths, the forbidden band gap width should be narrowed toward the interface relative to the photosensitive base member. This helps decrease the difference in the potential and, whereby the photo carriers formed in the sensitizing layer can be easily taken out. Therefore, this is also effective to increase the sensitivity for the light of long wavelengths.

When the semiconductor layers having different electric conductivities are used, the electrons and positive holes are isolated well by the junction electric field of photo carriers formed in the sensitizing layer by the irradiation of light, and the sensitivity can be substantially increased.

It is allowable to use semiconductor layers of these two kinds in combination, as a matter of course.

BEST MODE FOR CARRYING OUT THE INVENTION

In order to achieve the object of increasing the sensitivity for the light of long wavelengths mentioned above, the present invention deals with a composite structure which consists of two or more layers that are sensitive to the light of long wavelengths, that form carriers, and that have different optical or electrical characteristics. Very preferably according to the present invention, the layers for forming carriers are located close to the side that is to be negatively charged rather than the center of the electrophotographic member in the direction of thickness thereof.

The hydrogenated or halogenated amorphous silicon usually has an optical band gap of about 1.6 eV to 2.0 eV, and exhibits photoconductivity that drops abruptly near 1.55 to 1.58 eV where the wavelengths of light emitted by the semiconductor laser lie. In order to reduce the optical gap of this material and to increase the sensitivity for the light of long wavelengths, the amount of hydrogen or halogen contained in amorphous silicon should be decreased, or fine crystalline silicon should be contained in amorphous silicon, or germanium or tin other than silicon should be contained in amorphous silicon. However, these methods decrease the resistivity of the photosensitive base member and decrease the time constant of dark attenuation of surface charge of the electrophotographic member.

Figure 1:
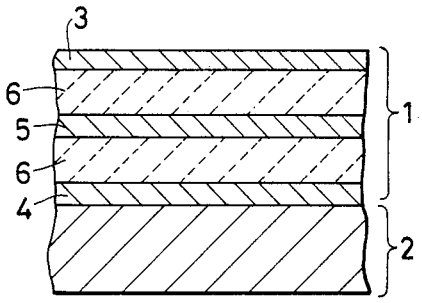
FIG. 1 is a diagram showing in cross section the structure of a photosensitive member according to the present invention.

In order to preclude such defects, the inventors have proposed the structure which is shown in FIG. 1. Namely, the inventors have proposed a photosensitive member of a composite structure in which a layer 3 or 4 of a material having a relatively large optical band gap and a large resistivity, is provided near the surface of a photosensitive member 1 (or near the interface relative to a substrate 2), and a layer 5 having a relatively small optical band gap and high sensitivity for the light of long wavelengths, is provided inside the photosensitive member 1.

In order to increase the optical band gap of a material that contains amorphous silicon, it is accepted practice to increase the content of hydrogen or halogen, or to mix such elements as oxygen, carbon and nitrogen in addition to silicon. To provide the layer 3 or 4 of a material having large optical band gap on the surface or on the interface of the photosensitive member 1, as done in the abovementioned example, is advantageous from the standpoint of preventing the electric charge formed by the corona discharge on the surface of the photosensitive member from being injected into the photosensitive member, or from the standpoint of preventing the resolution of the electrophotographic image from decreasing that is caused by the surface electric charge that diffuses in the direction of plane thereof. Namely, layer 3 or 4 contributes to improve the stability of the operation of the photosensitive member.

Figure 2:
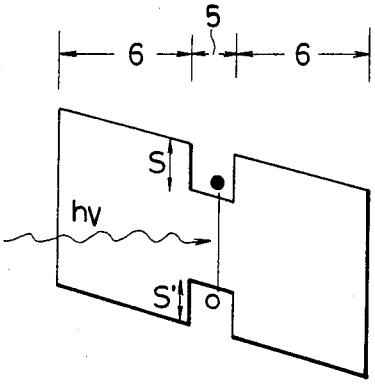
FIG. 2 is a diagram showing the band structure of the photosensitive member which is sensitive to the light of long wavelengths.
Figure 3A:
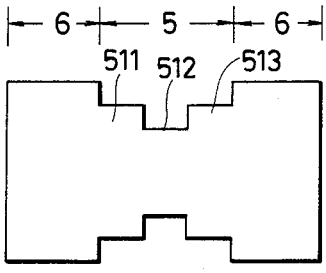
FIG. 3 is a diagram showing the band structures of sensitizing layers according to the present invention.
Figure 3B:
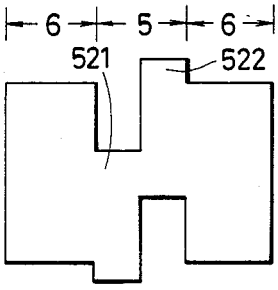
Figure 3C:
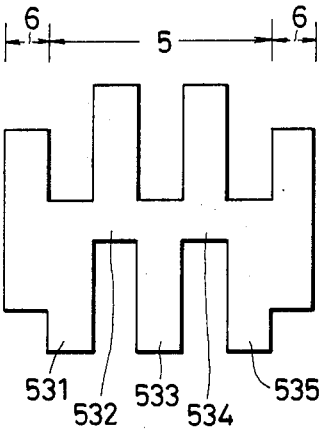
Figure 3D:
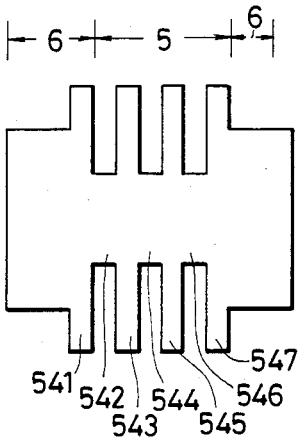

However, when most of, for example, more than 50% of the incident light is absorbed by the photosensitive member, the sensitizing layer 5 provided in the photosensitive member carries only a small proportion of the electric field that is applied to the whole photosensitive member, since it has a small optical band gap and a small resistivity compared with those of the high-resistance layer 3 or 4 on the surface. Moreover, due to the potential difference S or S' on the interface caused by the difference of optical band gap between the sensitizing layer 5 and the photosensitive base members 6 of the band structure shown in FIG. 2, the sensitizing layer 5 works as a well of potential hindering photo carriers formed in the sensitizing layer 5 from being taken out of the well. Therefore, the sensitizing layer 5 does not effectively exhibit the sensitizing effect for the light of long wavelengths but exhibits the sensitizing effect only to some extent. In FIG. 2, the same reference numerals as those of FIG. 1 denote the same portions.

In order to improve the above-mentioned defects according to the present invention, the sensitizing layer 5 has a substantially increased resistivity so as to be impressed with the electric field sufficiently, so that photo carriers formed in the sensitizing layer 5 can be easily taken to the external side.

FIG. 3 shows band structures of sensitizing layers according to the present invention, in cross section in a direction in which the photosensitive layers are laminated. In these cases, the long wavelength sensitizing layer 5 exists in the photosensitive base members 6 that contain amorphous silicon. In FIG. 3(*a*), the long wavelength sensitizing layer 5 is divided into three layers 511, 512 and 513 having different optical band gaps. The sensitizing layer 512 that exists at the center has an optical band gap that is narrower than that of the neighboring sensitizing layers 511 and 513. Therefore, the sensitizing layer 512 has the highest sensitivity for the light of long wavelengths. In this case, however, the potential difference at the interface is smaller than that of when the sensitizing layer is in direct contact with the photosensitive base members 6 of FIG. 2. Therefore, the photo carriers formed in the sensitizing layer 512 can be easily taken out to the external side. Further, the sensitizing layers 511 and 513 have a resistivity greater than the resistivity of the sensitizing layer 512, and establish an intense electric field. Therefore, the photo carriers that entered once into the sensitizing layers 511 and 513 can be taken into the photosensitive base members 6 more easily than in the case of FIG. 2. Although the sensitizing layer 5 was divided into three layers in this embodiment, it is of course allowable to divide the sensitizing layer into a number of layers so that the potential difference changes nearly continuously.

Referring to FIG. 3(*b*), the long wavelength sensitizing layer 5 is divided into two layers 521, 522 that form a pn junction. In the p-type layer, the electrons which are minority carriers govern the photoconductivity and in the n-type layer, the positive holes govern the photoconductivity. If the external electric field is so applied as to reversely bias the pn junction, a dark current flowing through the sensitizing layer 5 decreases strikingly compared with when there is no pn junction; i.e., dark attenuation characteristics of the photosensitive member are improved. Further, the photo carriers formed in the sensitizing layer 5 by the irradiation with light are isolated well by the junction electric field, enabling the photosensitivity to be substantially increased. With this structure, the potential difference increases at the interface between the sensitizing layer 5 and the photosensitive base members 6. If this structure is combined with the structure of FIG. 3(*a*), however, the optical band gap of the sensitizing layer 5 can be stepwisely increased near the interface relative to the photosensitive base members 6.

FIG. 3(*c*) shows the case where the long wavelength sensitizing layer 5 is divided into three or more layers, and the p-type layer and the n-type layer are alternately laminated. In the case of such a multi-layer pn junction structure, the semiconductor exhibits an optical band gap and a thermal gap of different values, the thermal gap being generally greater than the optical band gap. Therefore, the sensitizing layer 5 exhibits an electric resistance which is virtually greater than that of the case of a single layer, and is effective to increase dark resistance. Further, the photo carriers formed in the pn junction portion of the multi-layer structure are isolated by the junction electric field and form a space charge which works to reduce the potential difference in the pn junction portion. Owing to this function, the photo carriers formed in the sensitizing layer 5 can be easily taken into the photosensitive base members 6.

FIG. 3(*d*) shows a long wavelength sensitizing layer 5 of a structure in which a layer of a material having a wide optical band gap and a layer of a material having a narrow optical gap are alternately laminated. In this case, although the light of long wavelengths is absorbed by the layers having a narrow gap, presence of the layers having a wide gap helps increase the electric resistance of the sensitizing layer 5 as a whole. Here, if the thickness of each layer having wide gap exceeds 100 nm, it becomes difficult to take out the photo carriers that are formed in the layers having a narrow gap. However, if the thickness of the layers having a wide gap is smaller than 100 nm each, the photo carriers are allowed to pass through the barrier of the layers having a wide forbidden band gap owing to the tunnel effect established by the electric field, and are drawn into the photosensitive base members 6.

The individual layers that are alternately laminated have a thickness of larger than about 0.1 nm from the current technical level of forming films. The laminated-layer region constituting the sensitizing region should have a thickness of 1000 angstroms to 5 $\mu$m, and more preferably from 1000 angstroms to about 1 $\mu$m. Therefore, the layers can usually be laminated in a number of from several hundred to several thousand. The optical band gap is roughly selected as described below. Namely, 1.8 eV to 2.2 eV for the materials having wide optical band gaps, and 1.2 eV to 1.8 eV for the materials having narrow optical band gaps.

It is possible to maintain substantially increased the width of the region of narrow optical band gap while maintaining high the electric resistance of the sensitizing layer 5 as a whole utilizing the layers having wide optical band gap.

According to the present invention, the sensitizing layer 5 should exist in the internal side rather than on the surface of the photosensitive member 1 or on the interface relative to the substrate 2. In principle, there is no great difference in the operation characteristics regardless of whether the sensitizing layer exists in the photosensitive member 1 close to the surface thereof or close to the substrate 2 thereof. However, when the photosensitive member 1 is to be irradiated with intense light as in the case of a laser beam printer, attention should be given to that the sensitivity of the photosensitive member is often deteriorated. Namely, with the photosensitive member containing amorphous silicon, the range of positive holes decreases if it is irradiated with intense light for extended periods of time. On the other hand, the range of electrons is not so shortened as the range of positive holes. Therefore, when most of, for example, more than 50% of the photocurrent generated by the incident light, is supported by the electrons, the degree of deterioration caused by the reduction in the range of positive holes does not appear seriously. However, when most of the photocurrent is supported by the positive holes, the degree of deterioration appears seriously. In order to preclude adverse effects that stem from the phenomenon of deterioration, therefore, it is desired that the sensitizing layer that serves as a region for forming carriers is located on the negatively charged side rather than in the central portion of the photosensitive member in the direction of thickness thereof. In this case, the positive holes formed in the carrier-forming region need travel over a range shorter than that of the electrons. Therefore, the degree of deterioration in the film characteristics appears little.

[EMBODIMENTS OF THE INVENTION]

Embodiments of the invention will be explained below.

EMBODIMENT 1

An aluminum drum of which the surface is finely polished is introduced into a vacuum container that is evacuated to $1\times10^{-5}$ Torr. Then, a gaseous mixture of $SiH_4$ and $H_2$ containing $NH_3$ is introduced thereinto to a pressure of 0.8 Torr maintaining the temperature on the surface of the drum at 300° C., in order to deposit a film of a-$Si_xN_{1-x}$:H (hydrogenated amorphous silicon nitride) to a thickness of 100 nm by the high-frequency glow discharge of 13.56 MHz. The high-frequency electric power of 100 watts is used to effect the glow discharge. Then, $NH_3$ is removed from the gas that is introduced, and a film of a-Si:H (hydrogenated amorphous silicon) is deposited to a thickness of 3 μm by the glow discharge with the mixture gas consisting of $SiH_4$ and $H_2$. Thereafter, a film of a-$Si_yGe_{1-y}$:H (hydrogenated amorphous silicon-germanium) is deposited to a thickness of 0.5 μm by the glow discharge using a mixture gas consisting of $H_2$ and a gas of $SiH_4$ which contains 10% of $GeH_4$ in terms of pressure ratio, a film of a-$Si_zGe_{1-z}$:H is deposited to a thickness of 0.5 μm by the glow discharge using a gaseous mixture consisting of $H_2$ and a gas of $SiH_4$ which contains 20% of $GeH_4$, and a film of a:$Si_yGe_{1-y}$:H is deposited to a thickness of 0.5 μm by the glow discharge using a gaseous mixture consisting of $H_2$ and a gas of $SiH_4$ which contains 10% of $GeH_4$. These layers containing germanium serve as a long wavelength sensitizing layer. Then, a film of a-Si:H is deposited thereon to a thickness of 15 μm, and a film of a-$Si_xN_{1-x}$:H is formed to a thickness of 100 nm to form the uppermost layer by the glow discharge using a gaseous mixture consisting of $H_2$ and $SiH_4$ which contains $NH_3$, thereby to prepare an electrophotographic drum. This drum is used with the positive charge being charged on the surface thereof by corona discharge. The long wavelength sensitizing layer which is a photo carrier-forming region exists close to the aluminum drum that is a substrate. Therefore, the electrons chiefly migrate through the photosensitive member among the photo carriers formed by the laser beam of long wavelengths. Accordingly, excellent printing characteristics are obtained with less optical deterioration. It was also found that if a $CH_4$ gas is added in an amount of about 20% in forming the a-$Si_yGe_{1-y}$ layer and the a-$Si_zGe_{1-z}$ layer, the thermal stability increases without much deteriorating the sensitivity in the region of long wavelengths, and the mechanical strength increases, too.

EMBODIMENT 2

An aluminum drum is introduced into a vacuum container, and a film of a-Si:H is deposited to a thickness of 0.5 μm by the high-frequency sputtering, using a target of sintered silicon in an atmosphere of a gas of argon and hydrogen under the pressure of $1\times10^{-2}$ Torr. In this case, a $B_2H_6$ gas is mixed in an amount of 100 ppm into the atmosphere gas to form the a-Si:H layer of the p-type. This layer works to block the injection of electrons from the aluminum drum. Another a-Si:H layer without containing $B_2H_6$ is deposited thereon to a thickness of 2 μm by the high-frequency sputtering in the same manner as above. Then, a film of a-$Si_xSn_{1-x}$:H is deposited thereon to a thickness of 0.5 μm using a silicon target which contains 15 atomic % of tin. In this case, $B_2H_6$ is added at a concentration of 50 ppm to hydrogen in the atmosphere gas, to form a long wavelength sensitizing layer of the p-type. Using the same target, furthermore, $PH_3$ is added at a concentration of 30 ppm to hydrogen in the atmosphere gas to deposit a film of a-$Si_xSn_{1-x}$:H to a thickness of 0.5 μm. The long wavelength sensitizing layer is of the n-type. Thus, the p-type and n-type long wavelength sensitizing layers having the same thickness are alternately laminated each in a number of three; i.e., a total of six layers are laminated. Then, a layer of a-Si:H is deposited thereon to a thickness of 10 μm using the silicon target. Using the silicon target, furthermore, a layer a-$Si_yC_{1-y}$:H having high resistance is formed on the uppermost layer to a thickness of 0.1 μm by the high-frequency sputtering using a $CH_4$ gas under the pressure of $1\times10^{-2}$ Torr. Like that of Embodiment 1, the electrophotographic member thus prepared is used being positively charged, to exhibit excellent operation characteristics over a range of long wavelengths.

EMBODIMENT 3

A stainless-steel drum of which the surface is finely polished is introduced into a vacuum vessel which is evacuated to $1\times10^{-6}$ Torr. Then, oxygen containing 20% of argon in terms of pressure ratio is introduced thereinto to a pressure of $4\times10^{-3}$ Torr while maintaining the substrate temperature at 250° C. Using a sintered silicon target, a layer of $Si_xO_{1-x}$ is deposited to a thickness of 50 nm by the sputtering with a high-frequency discharge of 250 watts. Then, argon gas containing 50% of hydrogen in terms of pressure ratio is introduced instead of the aforementioned gas, in order to deposit a film of a-Si:H to a thickness of 3 μm under the pressure of $3\times10^{-3}$ *Torr.*

Next, using a sintered target having a composition of $Si_{90}Ge_{10}$, a layer of a-$Si_yGe_{1-y}$:H is deposited by sputtering to a thickness of 10 nm with the high-frequency discharge using argon gas which contains 50% of hydrogen in terms of pressure ratio. Then, using a sintered target having a composition of $Si_{50}C_{50}$, a layer of a-$Si_zC_{1-z}$:H is deposited by sputtering to a thickness of 10 nm with the high-frequency discharge in the same atmosphere. By using these two targets alternately, the a-$Si_yGe_{1-y}$:H layer and the a-$Si_zC_{1-z}$:H layer each having a thickness of 10 nm are laminated until the total thickness of 1 μm is reached. Thereafter, using a silicon target, a layer of a-Si:H is deposited thereon to a thickness of 10 μm and, finally, a layer of $Si_xO_{1-x}$ is deposited to a thickness of 10 nm using oxygen containing 20% of argon in terms of pressure ratio instead of the above-mentioned atmosphere gas. When used being positively charged, the thus obtained electrophotographic member exhibits excellent characteristics that deteriorate little, particularly when used as a photosensitive member for a laser beam printer that makes use of a laser source of long wavelengths, like those of the aforementioned embodiments.

According to the present invention as described above by way of embodiments, it is possible to realize a photosensitive member containing amorphous silicon that exhibits sensitivity over a range of long wavelengths, while restraining the time constant of dark attenuation from decreasing. The invention is further very effective to provide a photosensitive member that exhibits high sensitivity, by permitting the carriers to easily flow out from the photo carrier-forming region and suppressing adverse effects that stem from a reduced travelling range of positive holes after the photosensitive member is irradiated with the light over extended periods of time.

Figure 4A:
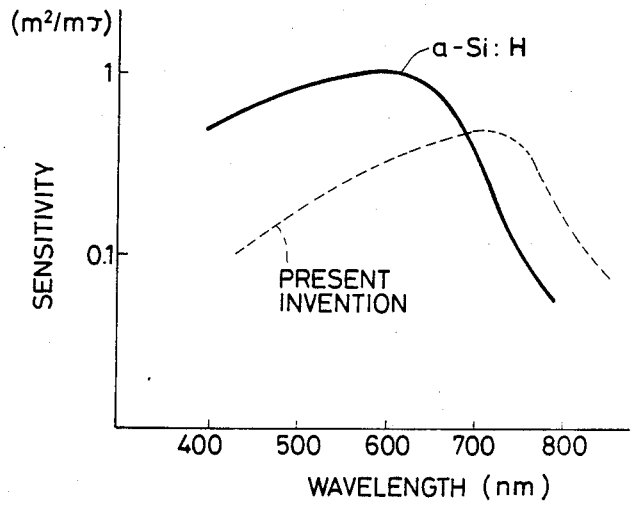
FIG. 4(*a*) is a graph showing the spectral sensitivity of the electrophotographic member of the present invention in comparison with that of the conventional electrophotographic member, and FIG. 4(*b*) is a graph showing the dark attenuation factor of voltage of the electrophotographic member of the present invention in comparison with that of the conventional electrophotographic member.
Figure 4B:
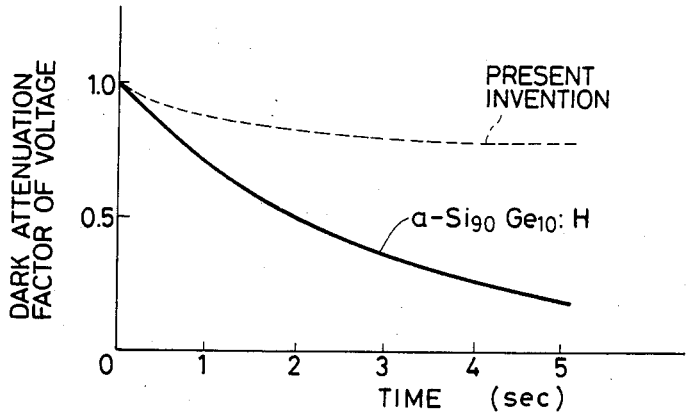

FIG. 4 shows spectral sensitivity and dark attenuation characteristics of a photosensitive drum of the structure of Embodiment 1, wherein the diagram (a) shows the spectral sensitivity of a drum without containing germanium in comparison with the spectral sensitivity of the drum of the present invention, manifesting the increase in the sensitivity over a range of long wavelengths, and the diagram (b) shows the dark attenuation characteristics of a photosensitive member in which germanium is contained homogeneously over the whole photosensitive member in comparison with the dark attenuation characteristics of the photosensitive member of the present invention, manifesting the retention of dark attenuation factors of the invention.

As will be obvious from the foregoing description, the present invention provides great industrial advantage.

INDUSTRIAL APPLICABILITY

The electrophotographic member of the present invention is very useful as a photosensitive member for a laser beam printer that makes use of a semiconductor laser.

What is claimed is:

1. An electrophotographic member having a photosensitive member of amorphous silicon containing at least one of hydrogen and halogen such that the photosensitive member is photoconductive, the photosensitive member including base members constituted by layers of the amorphous silicon, the photosensitive member further including a sensitizing layer of the amorphous silicon and having a narrower forbidden band gap width than that of the base members constituted by said layers of the amorphous silicon, and said sensitizing layer being formed by laminating at least two semiconductor layers having at least one of different forbidden band gap widths and different conductivities so as to provide an electrophotographic member containing amorphous silicon that is sensitive to light of longer wavelengths of 780–800 nm.

2. An electrophotographic member according to claim 1, wherein the lamination of semiconductor layers consists of a plurality of semiconductor films having different forbidden band gap widths that decrease successively in at least a given direction of lamination.

3. An electrophotographic member according to claim 1, wherein the lamination of semiconductor layers consists of a plurality of semiconductor films having different forbidden band gap widths, the semiconductor film located at the center has a minimum forbidden band gap width, and the forbidden band gap width of the films gradually increases as they go away from the central semiconductor film.

4. An electrophotographic member according to claim 1, wherein the lamination of semiconductor layers consists of a plurality of semiconductor films having different forbidden band gap widths, said semiconductor films having large forbidden band gap width and small forbidden band gap width being alternately laminated.

5. An electrophotographic member according to claim 1, wherein the lamination of semiconductor layers has at least a pair of semiconductor films having different electrical conductivities.

6. An electrophotographic member according to claim 1, wherein the lamination of semiconductor layers consists of a plurality of semiconductor films that have different electrical conductivities and that are alternately laminated.

7. An electrophotographic member according to claim 1, wherein the lamination of semiconductor layers has at least a pair of semiconductor films having different electric conductivities, and either one of the end portions of the lamination of layers has a plurality of semiconductor films having different forbidden band gap widths.

8. An electrophotographic member according to any one of claims 1 to 7, wherein one side of the electrophotographic member is adapted to be charged negatively, and wherein the lamination of semiconductor layers is located close to the side of the electrophotographic member adapted to be charged negatively rather than the central portion of said electrophotographic member in the direction of thickness thereof.

9. An electrophotographic member according to claim 1, wherein the lamination of semiconductor layers contains amorphous silicon and at least one element selected from the group consisting of amorphous or fine crystalline carbon, silicon-germanium and tin.

10. An electrophotographic member according to claim 2, wherein the base members and plurality of semiconductor films form an interface therebetween, and the plurality of semiconductor films have forbidden band gap widths that narrow toward said interface.

11. An electrophotographic member according to claim 4, wherein the semiconductor films having large forbidden band gap width have a thickness of at most 100 nm.

12. An electrophotographic member according to claim 11, wherein the lamination of semiconductor films has a thickness in the range of 1000 Å to 5 μm.

13. An electrophotographic member according to claim 12, wherein the large forbidden band gap widths are 1.8 eV to 2.2 eV, and the small forbidden band gap widths are 1.2 eV to 1.8 eV.

14. An electrophotographic member according to claim 1, wherein the photosensitive member is on a substrate.

15. An electrophotographic member according to claim 14, wherein the substrate is made of a conductive material.

16. An electrophotographic member according to claim 14, further comprising a p-type amorphous silicon layer formed between the substrate and base member of the photosensitive member so as to block injection of electrons from the substrate into the photosensitive member.

17. An electrophotographic member according to claim 1, wherein the photosensitive member comprises a pair of base members, the pair of base members sandwiching said sensitizing layer.

18. An electrophotographic member according to claim 17, wherein the photosensitive member is on a substrate.

19. An electrophotographic member according to claim 1, wherein said sensitizing layer has a sufficient resistivity so as to be able to have a sufficient electric field formed thereacross so that photocarriers formed in the sensitizing layer by irradiation with light can flow out of the sensitizing layer.

20. An electrophotographic member according to claim 1, wherein said sensitizing layer is formed by laminating three semiconductor layers, with the middle semiconductor layer having a relatively lower resistivity and the outer semiconductor layers having a relatively higher resistivity.

21. An electrophotographic member according to claim 1, wherein resistivity of said sensitizing layer increases in a direction toward the base members.

* * * * *